US007120991B2

(12) United States Patent
Yoshimori

(10) Patent No.: US 7,120,991 B2
(45) Date of Patent: Oct. 17, 2006

(54) METHOD FOR MANUFACTURING COIL DEVICE

(75) Inventor: Hitoshi Yoshimori, Yamatokoriyama (JP)

(73) Assignee: SHT Corporation Limited, Osaka (JP)

( * ) Notice: Subject to any disclaimer, the term of this patent is extended or adjusted under 35 U.S.C. 154(b) by 189 days.

(21) Appl. No.: 10/481,891

(22) PCT Filed: Dec. 10, 2001

(86) PCT No.: PCT/JP01/10815

§ 371 (c)(1),
(2), (4) Date: Jan. 2, 2004

(87) PCT Pub. No.: WO03/005384

PCT Pub. Date: Jan. 16, 2003

(65) Prior Publication Data

US 2004/0172806 A1 Sep. 9, 2004

(30) Foreign Application Priority Data

Jul. 3, 2001 (JP) ..... 2001-202339

(51) Int. Cl.
*H01F 7/06* (2006.01)
*H01F 5/00* (2006.01)

(52) U.S. Cl. ..... 29/606; 29/602.1; 29/605; 336/200

(58) Field of Classification Search ..... 29/602.1, 29/605, 606; 336/200, 223, 232
See application file for complete search history.

(56) References Cited

U.S. PATENT DOCUMENTS 1,656,933 A * 1/1928 Ahlstrand ..... 29/605
2,777,116 A * 1/1957 Gordon ..... 336/208
5,583,475 A * 12/1996 Raholijaona et al. ..... 336/229

FOREIGN PATENT DOCUMENTS

JP 04112509 A * 4/1992
JP 2000-277337 10/2000
JP 2001-148320 5/2001

* cited by examiner

*Primary Examiner*—David P. Bryant
*Assistant Examiner*—Sarang Afzali
(74) *Attorney, Agent, or Firm*—Armstrong, Kratz, Quintos, Hanson & Brooks, LLP

(57) ABSTRACT

The invention provides a process for fabricating a coil device which process comprises the steps of making an air-core coil 4 and fitting the air-core coil 4 around a core 1. The first step makes an air-core coil 4 comprising a plurality of unit coil portions 41, 42 arranged axially of the coil and each having one or a plurality of turns of conductor, each pair of unit coil portions adjacent to each other axially of the coil being different from each other in inner peripheral length. The fitting step fits the air-core coil 4 around the core 1 while at least partly forcing the unit coil portions 42 of small inner peripheral length inwardly of the unit coil portions 41 of great inner peripheral length by compressing the coil 4 axially thereof. The process realizes a high space factor without using a rectangular or trapezoidal conductor, and can be automated.

20 Claims, 11 Drawing Sheets

(a)

(b)

(a)

(b)

METHOD FOR MANUFACTURING COIL DEVICE

BACKGROUND OF THE INVENTION

1. Field of the Invention

The present invention relates to a process for fabricating coil devices to be provided in rectifier circuits, noise eliminating circuits, resonance circuits, etc., for use in various AC devices.

2. Description of the Related Art

The present applicant has proposed the process shown in FIGS. 13, (*a*), (*b*) for fabricating such coil devices (see the publication of JP-A No. 2000-277337). According to this fabrication process, a coil device as shown in FIG. 13(*b*) is fabricated by inserting one side portion of an air-core coil 8 into the center hole 70 of a C-shaped core 7 through a gap portion 71 thereof as shown in FIG. 13(*a*) and fitting the coil 8 around the core 7.

With this fabrication process, the air-core coil 8 separated from the core 7 is made, and the coil 8 is thereafter fitted around the core 7 to complete the coil device. The process is therefore simplified by eliminating the need to wind a wire around the core 7 and making the air-core coil 8 automatically.

In fabricating the above coil device, a rectangular conductor or trapezoidal conductor can be used as the conductor of the air-core coil in order to increase the ratio of the sectional area of the turns of conductor 9 passing through the center hole 70 of the core 7, to the total area of the center hole 70, i.e., the space factor of the conductor 9. When having the same cross sectional area as a round conductor, the rectangular conductor and trapezoidal conductor have a short side which is smaller than the diameter of the round conductor, so that an increased number of turns of conductor can then be accommodated in the center hole 70 of the core 7, hence a higher space factor. However, the rectangular or trapezoidal conductor has the problem of being more expensive than the round conductor.

Another process for fabricating a coil device of higher space factor is known which comprises winding a conductor 9 around a core 7 in the order indicated by the numerals of 1 to 13 in FIG. 14(*a*), and thereafter winding the conductor 9 around the core 7 in the order indicated by the numerals of 14 to 23 in FIG. 14(*b*) so as to provide one coil layer on the outer peripheral side of the core 7 and two coil layers on the inner peripheral side of the core 7. An increased number of turns of conductor can then be accommodated in the center hole 70 of the core 7 to result in a higher space factor.

The conduct 9 is nevertheless difficult to wind around the core 7 automatically and must be wound manually, which involves the problem of low production efficiency.

Accordingly, an object of the present invention is to provide a process for fabricating a coil device which process can be practiced automatically and achieves a high space factor without using a rectangular or trapezoidal conductor.

SUMMARY OF THE INVENTION

The present invention provides a process for fabricating a coil device comprising a coil fitted around a core which process has the steps of:

making an air-core coil comprising a plurality of unit coil portions arranged axially of the coil, each of the unit coil portions having one or a plurality of turns of conductor, each pair of unit coil portions adjacent to each other axially of the coil being different from each other in inner peripheral length, and fitting the air-core coil around the core while at least partly forcing the unit coil portions of small inner peripheral length inwardly of the unit coil portions of great inner peripheral length by compressing the air-core coil axially thereof.

In the process of the invention, the air-core coil making step provides an air-core coil of single layer, which is compressed axially thereof in the coil fitting step, whereby the unit coil portions of small inner peripheral length are at least partly forced inwardly of the unit coil portions of great inner peripheral length to position these coil portions in a lapping relation. The air-core coil of single layer is therefore fitted around the core as a coil of plurality of layers. The coil device obtained consequently accommodates a larger number of conductor portions in a definite area than in conventional like coil devices, hence a higher space factor.

The step of fitting the air-core coil around a core eliminates the need for the step of winding a conductor around the core, while the air-core coil making step and fitting step can be automated.

Thus, the coil device fabricating process of the invention can be practiced automatically and affords coil devices of high space factor irrespective of the type of conductor used.

DETAILED DESCRIPTION OF THE PREFERRED EMBODIMENT

The present invention as practiced for fabricating a choke coil will be described below in detail with reference to the drawings.

Figure 1:
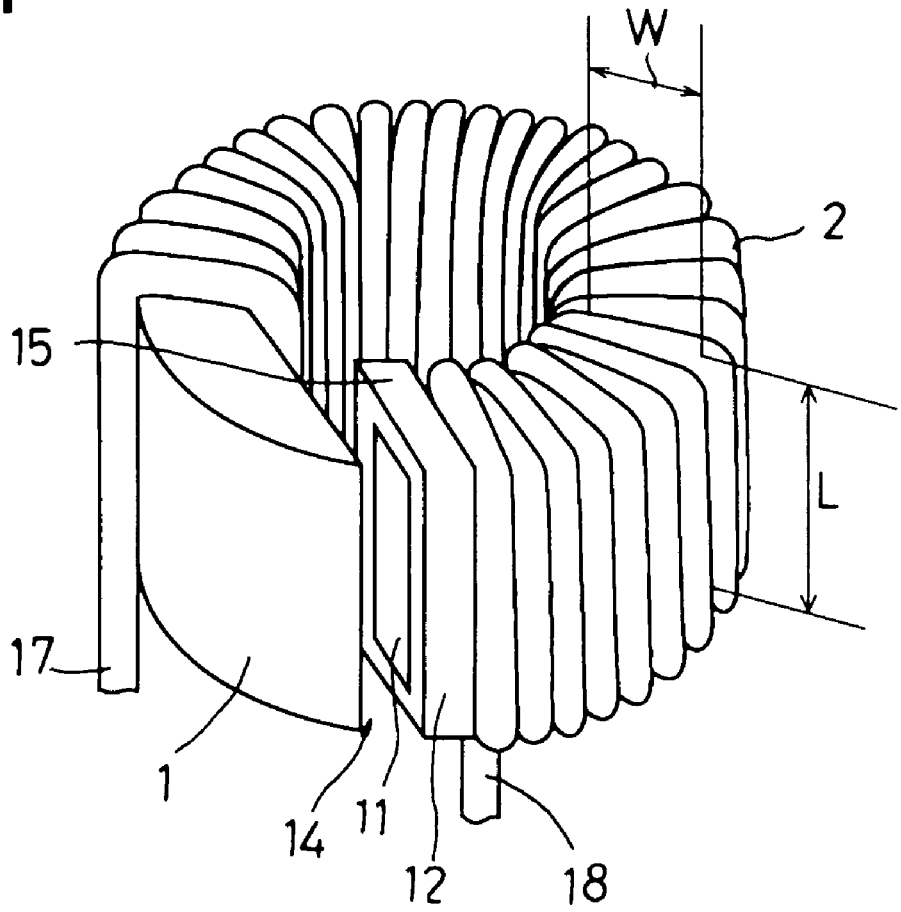
FIG. 1 is a perspective view of a choke coil device obtained by a coil device fabricating process of the invention.

FIG. 1 shows a choke coil device produced by the coil device fabrication process of the invention. The choke coil device comprises a C-shaped core 1 having a gap portion 14 and a coil 2 around the core 1. A conductor for forming the coil 2 is wound on the core 1 in the form of a single layer on the outer peripheral side thereof and two layers on the inner peripheral side thereof. Opposite ends of the coil conductor extend in the same direction, providing a pair of leads 17, 18.

The core 1 comprises a C-shaped core member 11 having a gap serving as the gap portion 14, and an insulating layer 12 covering the surface of the core member 11 except a pair of core end faces defining the gap portion 14. With reference to FIG. 1, the radial width of the core 1 is represented by W, and the height thereof by L.

In a plane orthogonal to the central axis of the core 1, the direction in which the gap portion 14 of the core 1 extends is inclined with respect to a radial direction of the core 1 and away from the center axis of the core 1. A projection 15 extending inwardly of the core 1 is formed at a position close to the core end face which is the shorter of the two end faces defining the gap portion 14 in the distance from the center of the core. The distance between the pair of core end faces, i.e., the width of the gap portion 14, is slightly greater than the diameter of the conductor making the coil 2.

Figure 2:
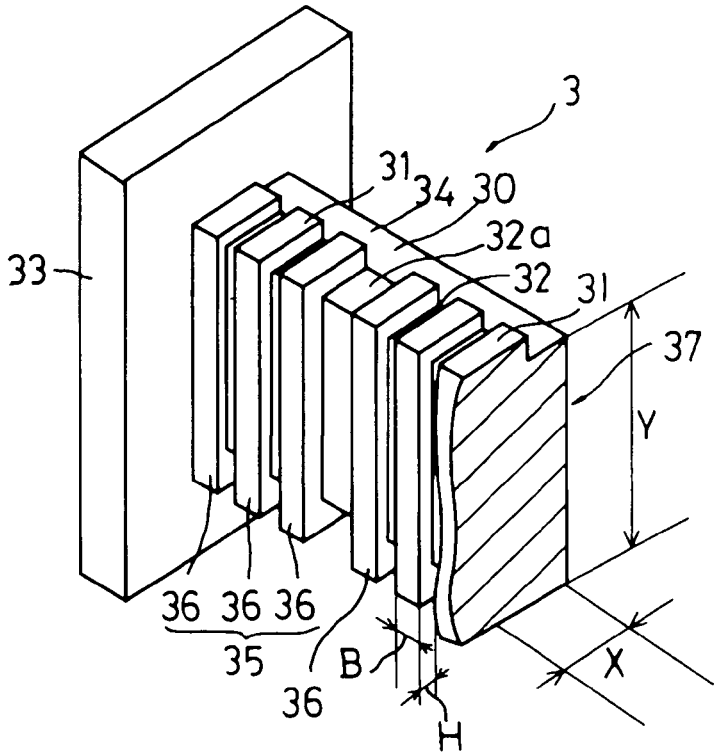
FIG. 2 is a perspective view partly broken away and showing a wire winding jig for use in the fabrication process.
Figure 3:
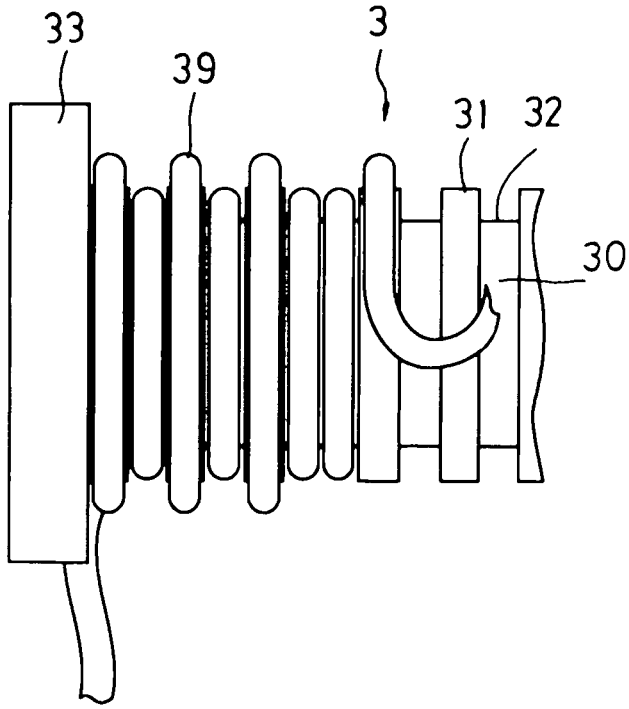
FIG. 3 is a view showing a conductor as wound on the jig.

In the process of the present invention for fabricating the coil device, an air-core coil is made first using a wire winding jig 3 shown in FIG. 2. The jig 3 comprises a winding core 30 extending from a support plate 33. The winding core 30 comprises a prism 34 having a rectangular cross section and a plurality of ridges 36 provided on one side portion of the prism 34. The other side portion 37 of the prism 34 opposite to the ridges 36 is planar.

The cross section of the prism 34 of the winding jig 3 along a plane perpendicular to the length of the prism is so determined that the width X and the height Y of the section are slightly greater than the width W and the height L of the core 1. Each of the ridges 36 of the jig 3 has a channel-shaped cross section to extend along approximately one half of the outer periphery of the prism 34. The ridge 36 has a height H, as measured from the surface of the prism 34, which is slightly larger than the diameter of the conductor, and such a width B along the length of the prism 34 that one conductor can be wound around the ridge.

The ridges 36 of the jig 3 include three successive ridges 36, 36, 36 which are arranged at a spacing permitting one conductor to be wound around the prism. The ridges 36 are divided into a plurality of groups 35 each of which comprises such three successive ridges 36, 36, 36 and which are arranged at a spacing enabling two conductors to be wound around the prism. Thus the surface of the jig 3 has regions in which two conductors can be wound around the surface and which are provided in specified cycles, with a plurality of areas arranged between the regions for winding one conductor around the surface in each area.

Incidentally, the winding core 30 of the wire winding jig 3 comprises a plurality of members and can be assembled from and disassembled into these members, whereas the winding core is illustrated in FIG. 2 as being in the form of a single member for the convenience of illustration.

Thus, the jig 3 has first winding core portions 31 provided by the areas having the ridges 36 and second winding core portions 32 each provided by the area between each pair of adjacent ridges 36, 36.

Figure 4:
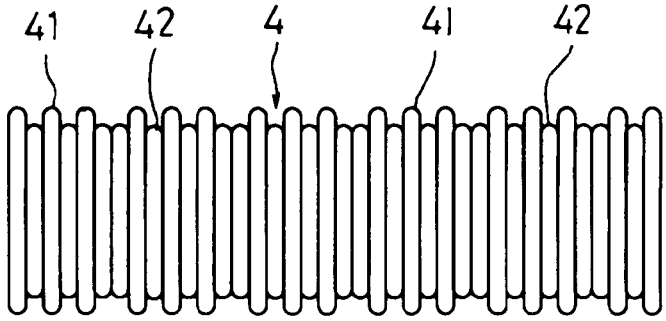
FIG. 4 is a front view of an air-core coil obtained by the step of making an air-core coil according to the invention.

In the step of making the air-core coil, a conductor 39 is wound around the winding core 30 along the surfaces of the respective winding core portions 31, 32, from core portion to core portion, starting with the support plate side of the jig 3. In this step, the conductor 39 is wound around the core portions 31, 32 one turn or two turns in accordance with the width of the core portion. After the conductor 39 has been wound on the core portion at the outer end of the jig 3 in this way, the winding core 30 is disassembled for removal. As a result, an air-core coil 4 is obtained as shown in FIGS. 4 and 5.

The air-core coil 4 has first unit coil portions 41 having a large inner peripheral length and formed around the first winding core portions 31 of the jig 3, and second unit coil portions 42 having a small inner peripheral length and formed around the second winding core portions 32 of the jig 3, the unit coil portions 41 and 42 being arranged alternately.

Figure 5:
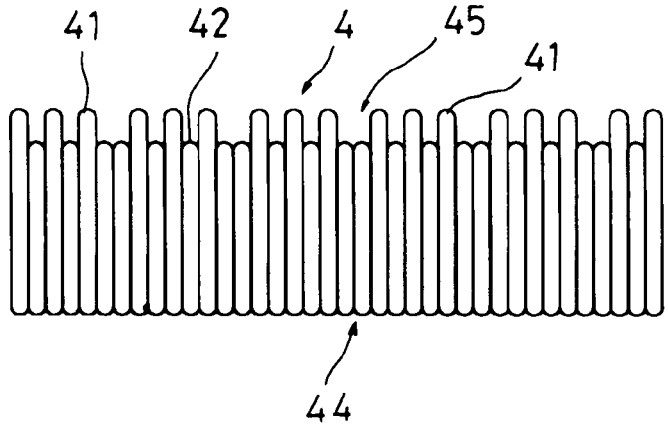
FIG. 5 is a bottom view of the air-core coil.

With reference to FIG. 5, the air-core coil 4 has one side portion 44 which is formed along the planar side portion 37 of the jig 3 and in which the first unit coil portions 41 and the second unit coil portions 42 have their outer surfaces aligned. However, in the other side portion 45 of the coil 4 which is formed along the ridges 36 of the jig 3, the outer surfaces of the first unit coil portions 41 are positioned as projected outward beyond the outer surfaces of the second unit coil portions 42 to provide a rugged contour. The side portion 44 will hereinafter be referred to as the "planar side portion" 44, and the other side portion 45 as the "rugged side portion" 45.

Figure 6:
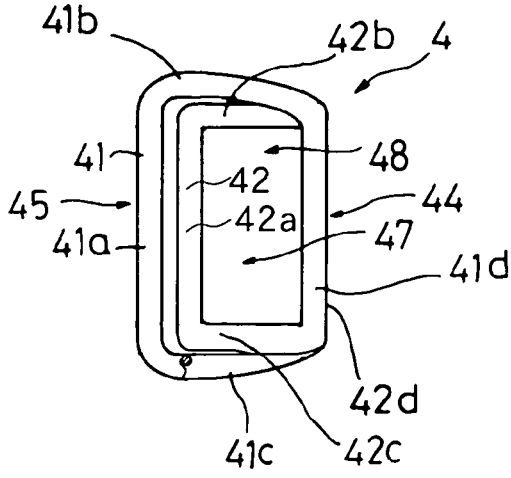
FIG. 6 is a side elevation partly broken away and showing the air-core coil.

FIG. 6 specifically shows the configurations of the first unit coil portion 41 and the second unit coil portion 42 of the air-core coil 4. The first unit coil portion 41 is in the form of a trapezoidal loop comprising first to fourth conductor portions 41*a*, 41*b*, 41*c*, 41*d*. The second unit coil portion 42 is in the form of a rectangular loop comprising first to fourth conductor portions 42*a*, 42*b*, 42*c*, 42*d*. The fourth conductor portion 41*d* corresponding to the short base of a trapezoid and included in the first unit coil portion 41 is in register with the fourth conductor portion 42*d* of the second unit coil portion 42 as illustrated, and the planar side portion 44 comprises these fourth conductor portions 41*d*, 42*d*. The first conductor portion 41*a* corresponding to the long base of the trapezoid and included in the first unit coil portion 41 is positioned outwardly of the first conductor portion 42*a* of the second unit coil portion 42, and the rugged side portion 45 comprises these first conductor portions 41*a*, 42*a*. The second and third conductor portions 41*b*, 41*c* corresponding to the two legs of the trapezoid and included in the first unit coil portion 41 extend from the positions of the opposite ends of the fourth conductor portion 41*d* toward the positions of the opposite ends of the first conductor portion 41*a*, as spaced apart form each other by an increasing distance.

The space 48 defined by the first to fourth conductor portions 42*a* to 42*d* of the second unit coil portion 42 is in the form of a rectangle slightly larger than the cross section of the core 1 along a radial direction thereof. The space 47 defined by the first to fourth conductor portions 41*a* to 41*d* of the first unit coil portion 41 is so sized as to include the space 48 of the second unit coil portion 42, and entire first conductor portion 42*a* and parts of the second and third conductor portions 42*b*, 42*d* of the second unit coil portion 42.

Stated more specifically, there is a small clearance formed between the first conductor portion 41*a* of the first unit coil portion 41 and the first conductor portion 42*a* of the second unit coil portion 42 and extending axially of the coil over the entire area of the first conductor portion side thereof, and there are small clearances formed between the second and third conductor portions 41*b*, 41*c* of the first unit coil portion 41 and the second and third conductor portions 42*b*, 42*c* of the second unit coil portion 42, extending axially of the coil and positioned locally in inside regions of the first conductor portion side thereof. These small clearances need not always be provided but the first conductor portions 41*a*, 42*a* may slightly lap over each other when seen from one side.

Figure 7:
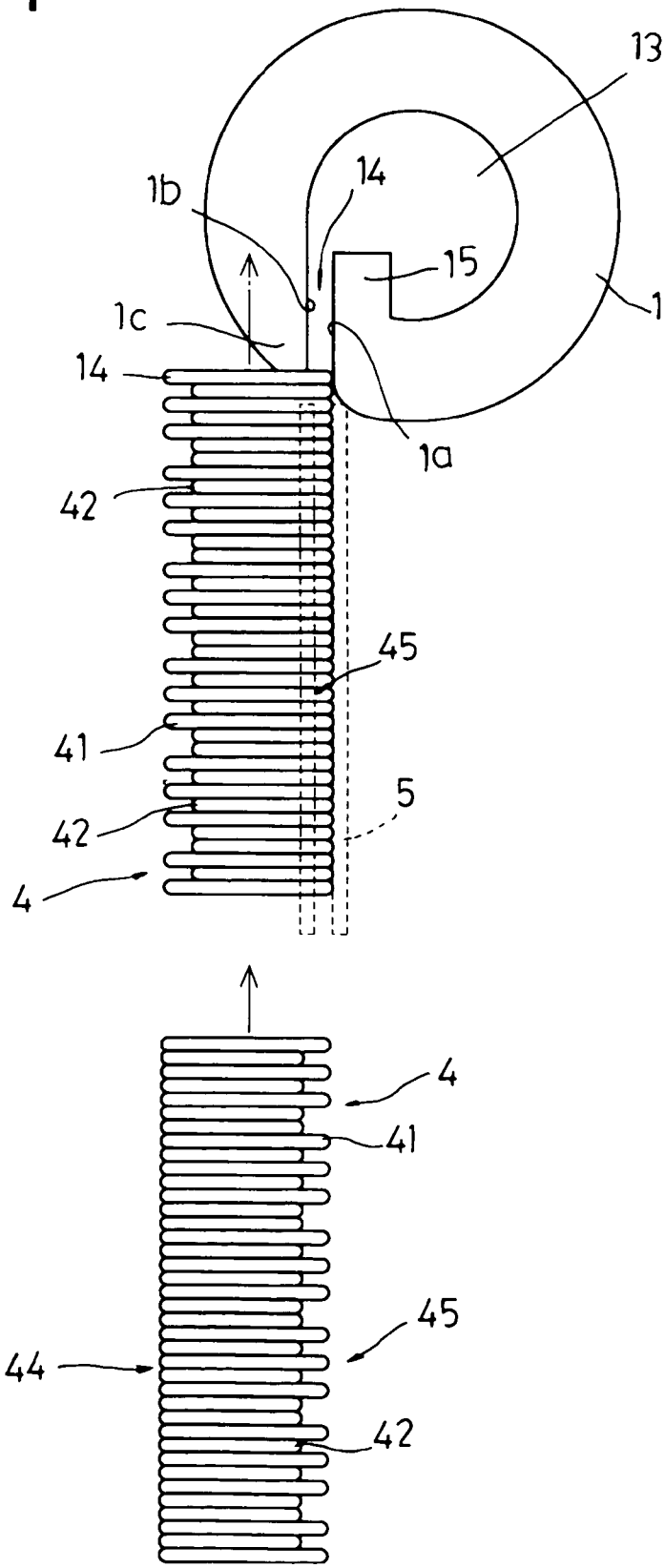
FIG. 7 is a view of the air-core coil fitting step of the invention for illustrating how to insert the air-core coil into a gap portion of a core.
Figure 8:
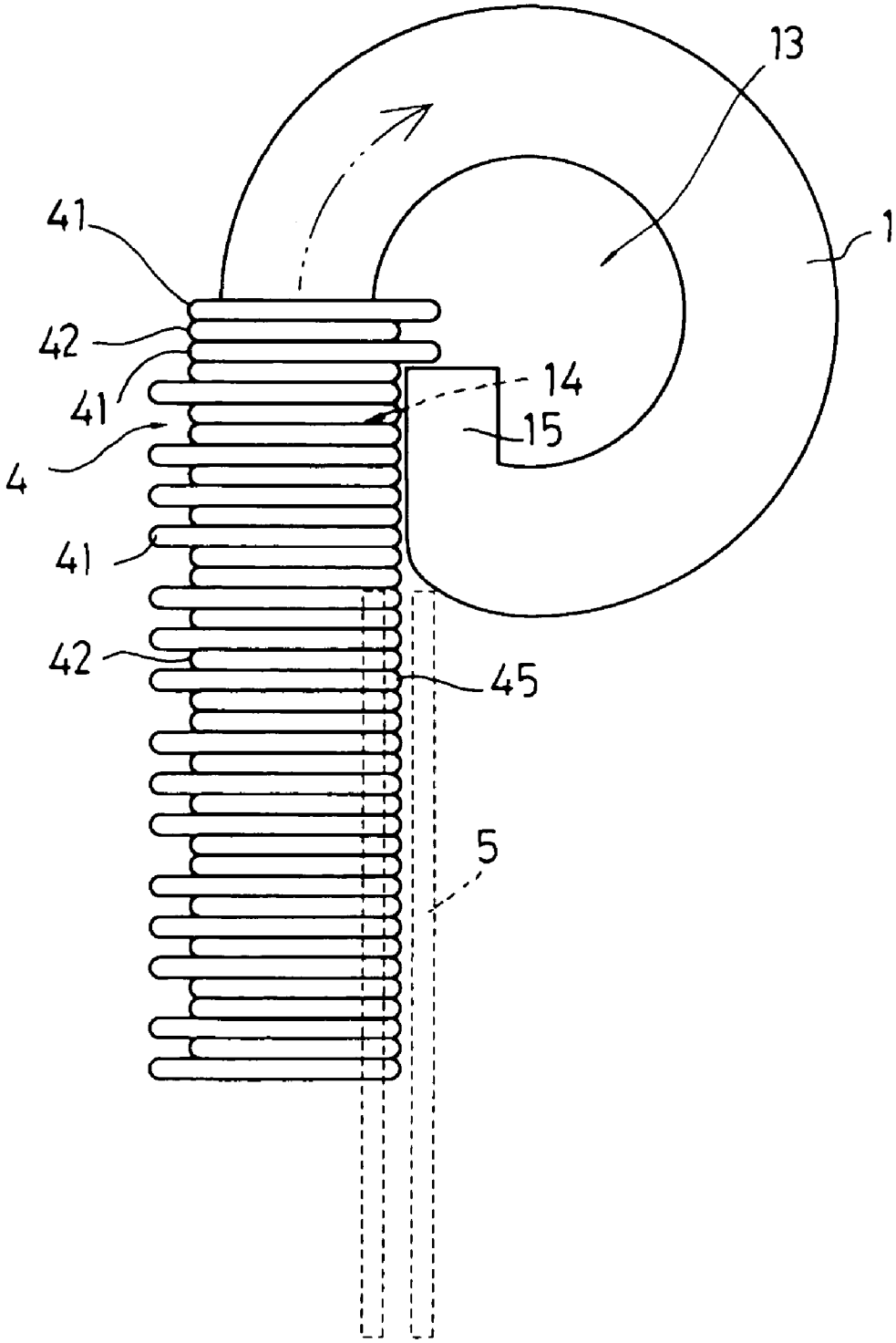
FIG. 8 is a view of the same step showing how the air-core coil restores itself upon the forward end thereof passing through the gap portion.

With reference to FIGS. 7 and 8, the air-core coil 4 is thereafter fitted around a core 1 in the step of fitting the air-core coil 4. First as shown in FIG. 7, the rugged side portion 45 of the air-core coil 4 is forced into the gap portion 14 of the core 1 so that the core end 1*c* having a core end face 1*b* which is more remote from the core center of the two core end faces 1*a*, 1*b* defining the gap portion 14 of the core 1 will enter the center bore of the coil 4. The rugged side portion 45 of the coil 4 is forced into the gap portion 14 of the core 1 while correcting the rugged side portion 45 to a flat shape by clamping the portion 45 with an insertion assisting tool 5, whereby the side portion 45 of the coil 4 is passed through the gap portion 14 having a width slightly larger than the diameter of the conductor 39.

When the air-core coil 4 is further pushed into the core 1, the side portion 45 of the coil 4 moves into the center hole 13 of the core 1 through the gap portion 14, first at the unit coil portion 41 at the coil forward end and then from coil portion to coil portion as shown in FIG. 8. With this movement, the side portion 45 is released from the clamping force and elastically restores itself to the original rugged shape in the center hole 13 of the core 1, with the outer surfaces of the first unit coil portions 41 projecting toward the core center beyond the outer surfaces of the second unit coil portions 42. In this way, the entire length of the side portion 45 is forced into the center hole 13 by pushing in the coil 4.

Figure 9:
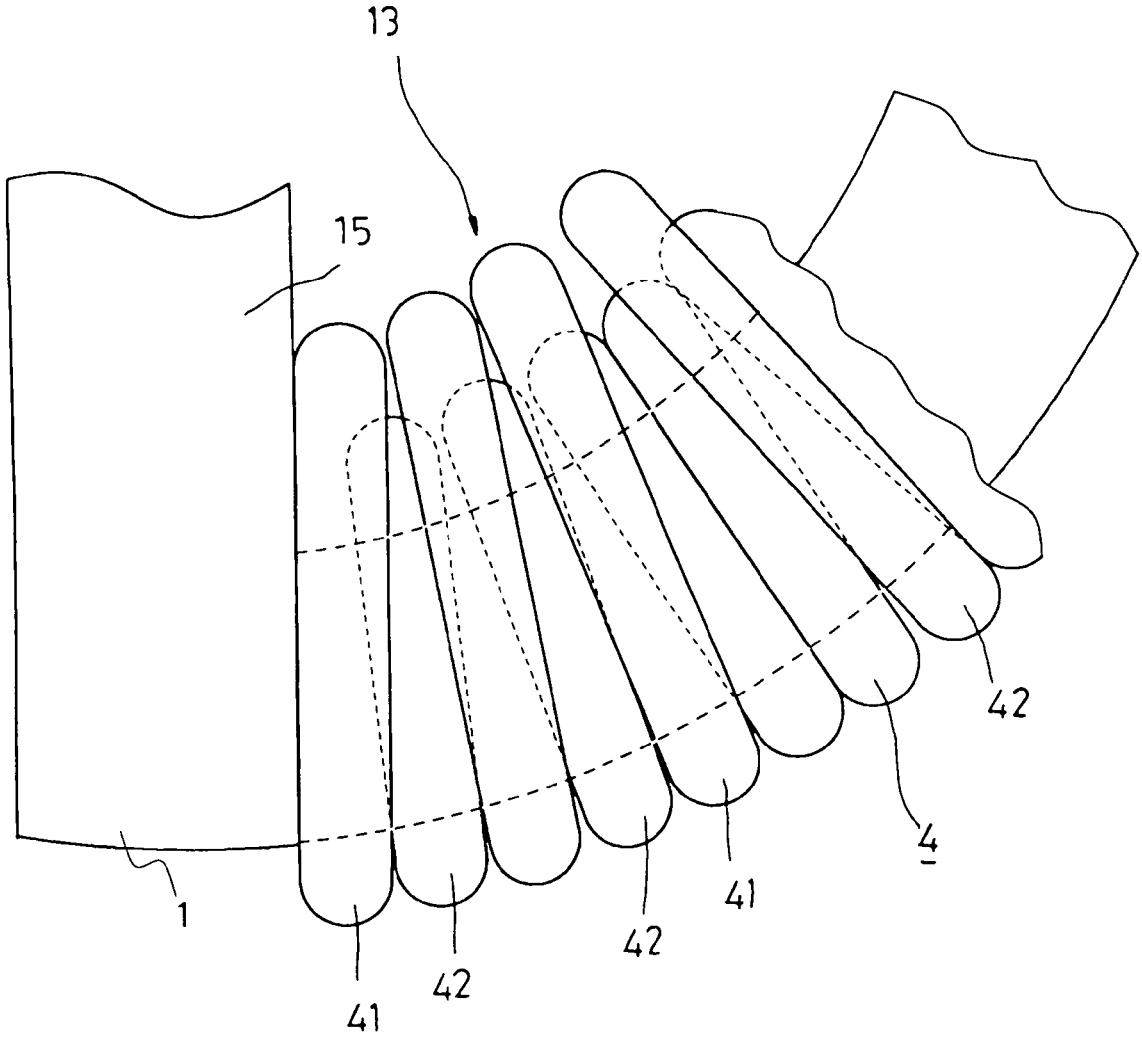
FIG. 9 is an enlarged fragmentary plan view of the choke coil device obtained by the step.

In this step, the forward end of the air-core coil 4 comes into contact with the projection 15 of the core 1 as shown in FIG. 9. When further pushed, the coil 4 is subjected to a compressive force acting axially of the coil, whereby the second unit coil portion 42 of the coil 4 is forced inwardly of the first unit coil portion 41 on the inner peripheral side of the core 1. At this time, since a small clearance is formed at the rugged side portion 45 of the air-core coil 4 between the first conductor portion 41*a* of the first unit coil portion 41 and the first conductor portion 42*a* of the second unit coil portion 42 as shown in FIG. 6, the second unit coil portion 42 is smoothly pushed inwardly of the first unit coil portion 41, without the likelihood of the first conductor portions 41*a*, 42*a* interfering with each other.

Incidentally, even when there is no clearance between the first conductor portions 41*a*, 42*a* or even if the first conductor portions 41*a*, 42*a* slightly lap over each other before the air-core coil 4 is compressed, the second and third conductor portions 42*b*, 42*c* are bent by the compression of the coil 4, so that the second unit coil portion 42 can be pushed inwardly of the first unit coil portion 41.

Figure 10:
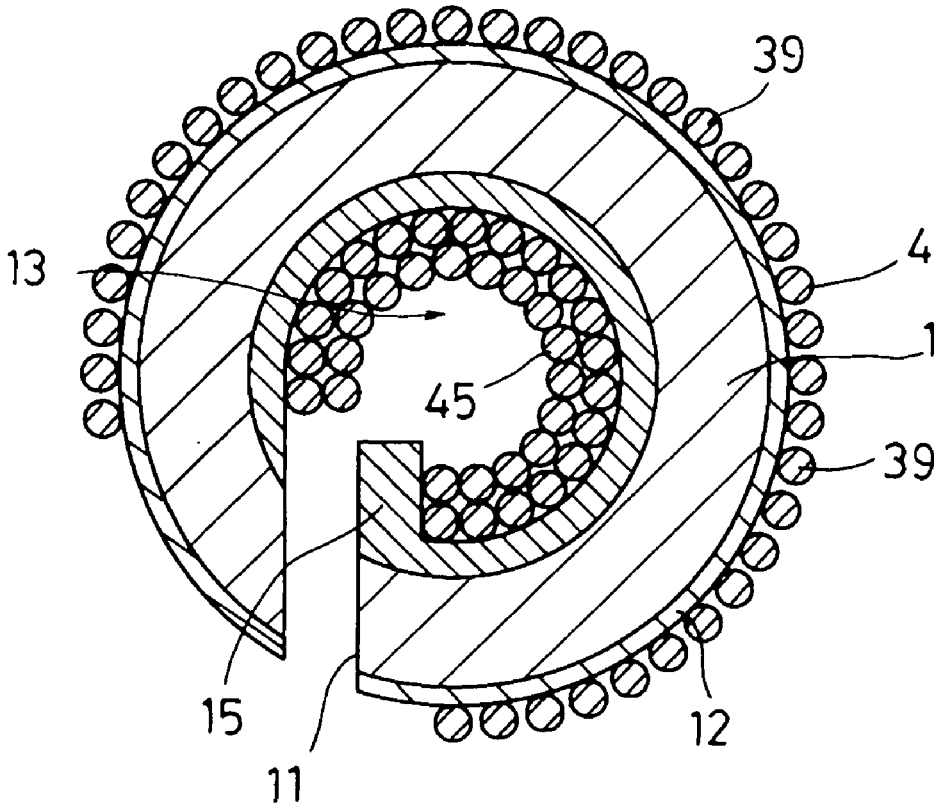
FIG. 10 is a sectional view of the choke coil device.

As a result, the coil 4 is made to have two layers within the center hole 13 of the core 1 as shown in the sectional view of FIG. 10.

Figure 11:
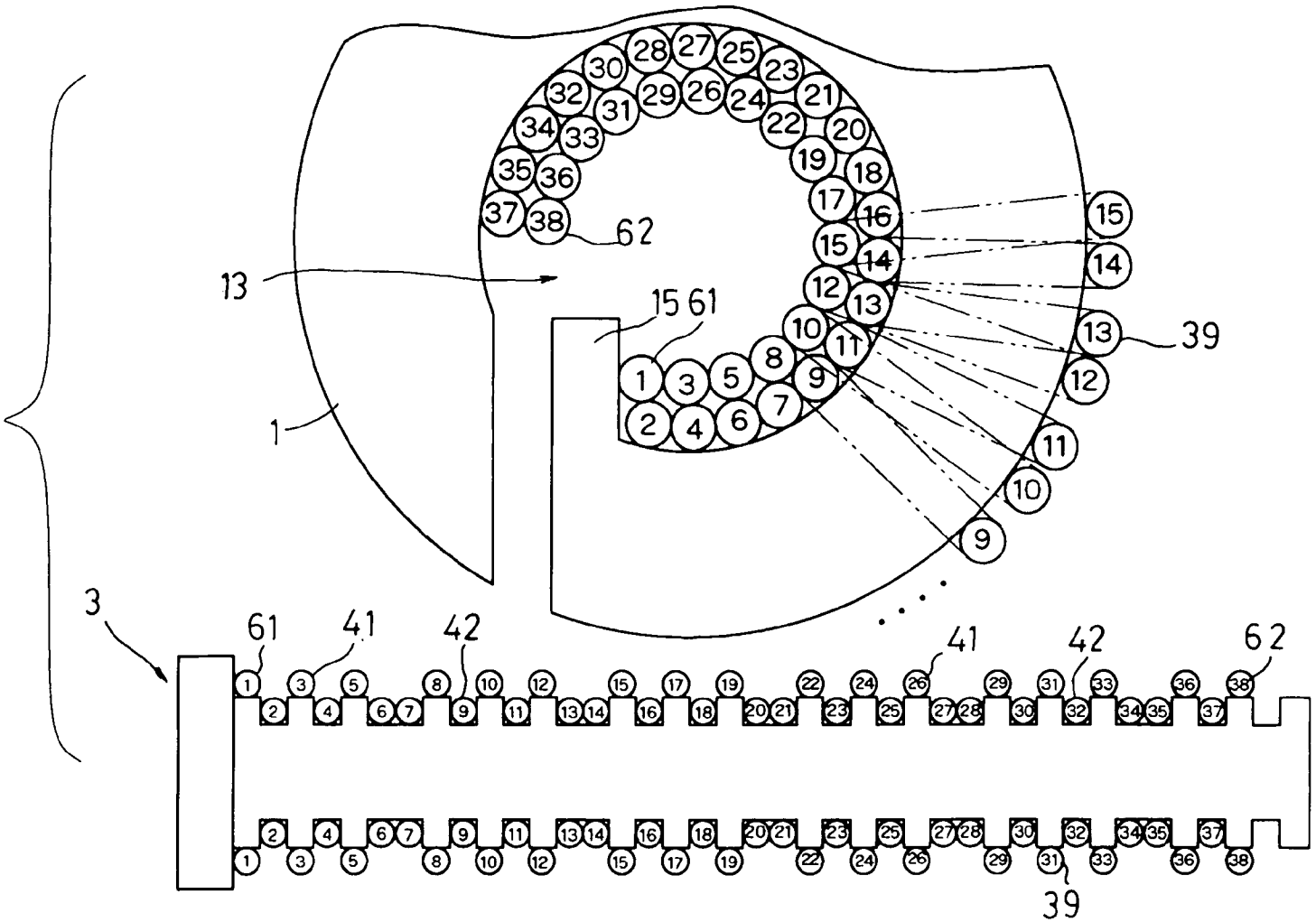
FIG. 11 is a diagram showing the relationship between the order in which a conductor is wound on the jig and the positions of unit coil portions of the air-core coil during the fabrication of the coil device according to the invention.

FIG. 11 shows the winding order indicated by the numerals of 1 to 38 when the conductor 39 is wound around the wire winding jig 3 to form unit coil portions 41, 42 in the air-core coil making step described above. In this drawing, the positions of the unit coil portions when the air-core coil 4 made is fitted around the core 1 are represented by the numerals showing the winding order.

The drawing shows that the first unit coil portion 41 and the second unit coil portion 42 formed in succession by winding the conductor around the jig 3 and as indicated, for example, by 3 and 4, or by 23 and 24 are placed one on the other in the core center hole 13 to form a two-layer structure comprising a first layer of second unit coil portions 42 and a second layer of first unit coil portions 41.

According to the present embodiment, the intervals between the ridges 36 of the winding jig 3 are changed from a value correspond to the size of one conductor to a value corresponding to the combined size of two conductors in specified cycles as seen in FIG. 11. However, if the pitch of the ridges 36 is made constant to compose the air-core coil with unit coil portions all of which are same in the number of turns, the following problem will arise.

Since the air-core coil is bent to a C shape when fitted around the C-shaped core, the first layer formed by the second unit coil portions 42 and the second layer formed by the first unit coil portions 41 in the core center hole differ in the radial distance from the core center, whereas the first unit coil portions 41 and the second unit coil portions 42 which are the same in the number of turns are to be arranged along circumferential lines of different radii. Accordingly, the pairs of successive first and second unit coil portions 41, 42 will shift and move away from each other gradually from pair to pair, with the result that the two kinds of coil portions 41, 42 can not be wound neatly in order in contact with each other.

According to the present embodiment, on the other hand, the intervals between the ridges 36 of the jig 3 are changed from a value corresponding to the size of one conductor to a value corresponding to the combined size of two conductors in specified cycles as described above so as to position a second coil portion 42, which is two in the number of turns, between second unit coil portions 42 each comprising one turn of conductor in specified cycles. Thus, such second unit coil portions 42 comprising two turns of conductor provide a difference in number between the first unit coil portions 41 and the second unit coil portions 42 which are to be arranged along respective circumferential lines of different radii. This eliminates the shift of the successive first and second unit coil portions 41, 42 relative to each other, making it possible to form the first unit coil portions 41 and the second unit coil portions 42 in layers, with the two kinds of coil portions held in contact with each other, and to obtain a coil as neatly wound in order.

The coil device fabricating process of the present invention described above provides a coil device wherein conductors are arranged in a plurality of layers in the center hole 13 of a core 1 and which therefore accommodates a larger number of conductor portions in the center hole 13 of the core 1 than in the conventional coil device. The present coil device therefore has a high space factor.

Further even if a core of reduced diameter is used, the same number of conductor portions as before the reduction of diameter can be accommodated in the diminished center hole. This serves to provide a compacted coil device without entailing impaired characteristics.

The air-core coil 4 can be made automatically by using the wire winding jig 3, and the coil 4 can be fitted around the core 1 also automatically. Accordingly, the fabrication process can be automated in its entirety to realize a remarkably improved production efficiency.

Figure 14:
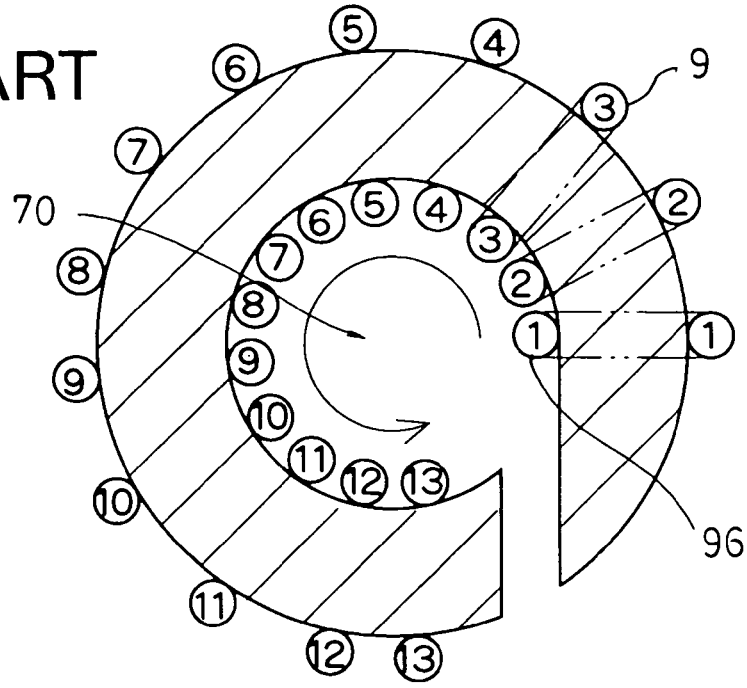
FIG. 14 PRIOR ART
FIG. 14 includes diagrams showing steps included in another conventional process for fabricating a choke coil.
Figure 14:
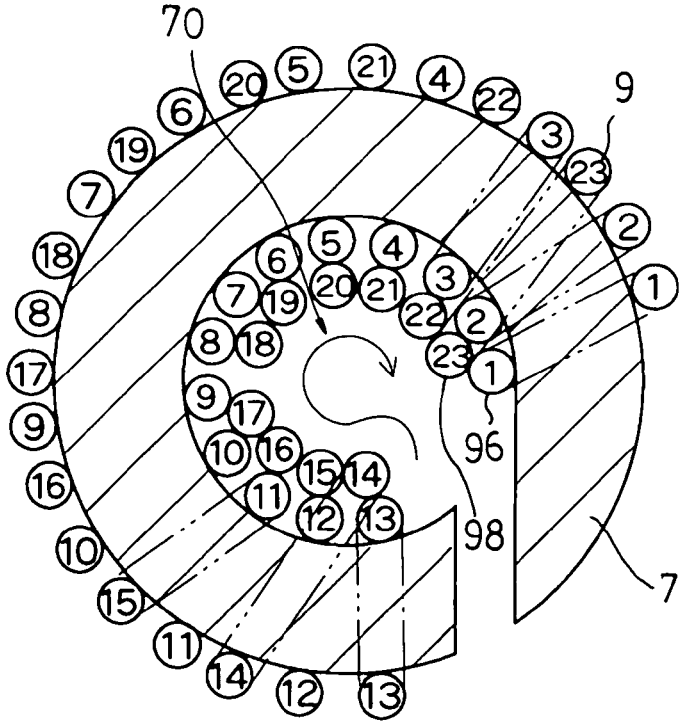
FIG. 14 PRIOR ART

Furthermore, coil devices of improved frequency characteristics are made available. With the coil device shown in FIGS. 14, (*a*) and (*b*) wherein the coil is wound manually, a conductor end 96 which is the first in the order of winding and a conductor end 98 which is the last in the order of winding are in lapping relation, and the overall voltage of the coil is applied across these two conductor ends 96, 98, so that there arises the problem of insufficient voltage resistance between conductor portions. The conductor portions of the first coil layer in the center hole 70 of the core 7 are greatly different from those of the second coil layer arranged therein in the order of winding, and these different conductor portions are in lapping arrangement. This results in a great stray capacity, giving rise to the problem that the coil device exhibits impaired frequency characteristics.

With the coil device of the present invention, on the other hand, the conductor end 61 of the coil 4 on the core 1 which is the first in the order of winding is a sufficient distance way from the conductor end 62 of the coil 4 which is the last in the order of winding as shown in FIG. 11, and each pair of successive unit coil portions 41, 42 are arranged in contact with each other and are therefore small in voltage difference. This ensures improved insulation between conductor portions and provides high frequency characteristics because of a diminished conductor-to-conductor stray capacity.

The device of the present invention is not limited to the foregoing embodiment in construction but can be modified variously within the technical scope set forth in the appended claims. For example, the unit coil portions constituting the air-core coil are not limited to two kinds, i.e., unit coil portions of small inner peripheral length and unit coil portions of great inner peripheral length, but the air-core coil can be composed of at least three kinds of unit coil portions which are different in inner peripheral length.

The wire winding jig is not limited in configuration to the one included in the above embodiment, but jigs of various shapes are usable insofar as air-core coils can be made wherein adjacent unit coil portions are different in inner peripheral length.

The core for providing the coil device is not limited to the C-shaped core described. Also useful is a barlike core, or an annular core comprising a C-shaped core piece and obtained by closing the gap portion of the core piece with a magnetic material after fitting an air-core coil around the core piece.

Figure 12:
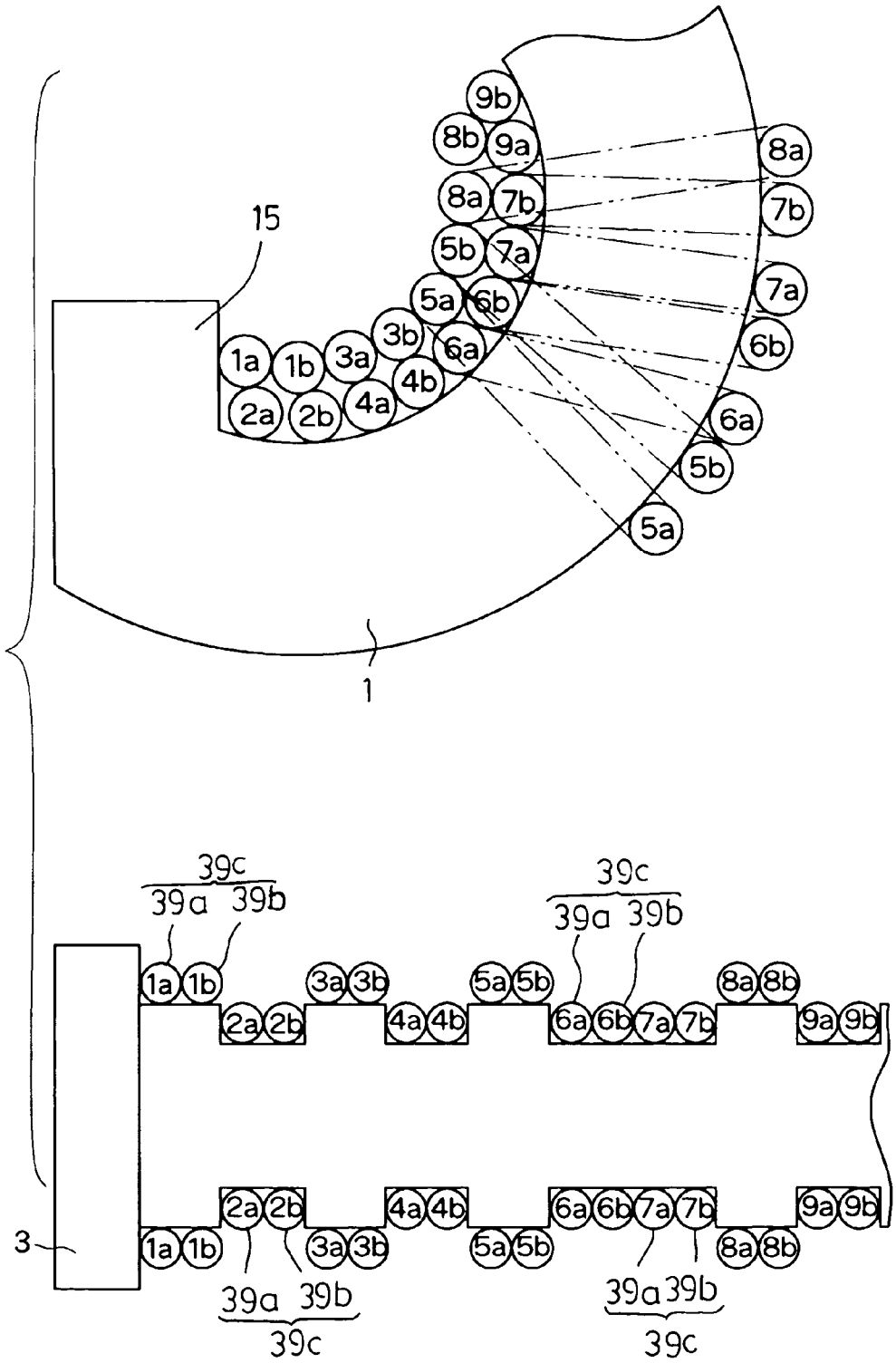
FIG. 12 is a diagram showing the same relationship as above involved in the fabrication of a coil device with use of a bundle of two conductors.
Figure 13:
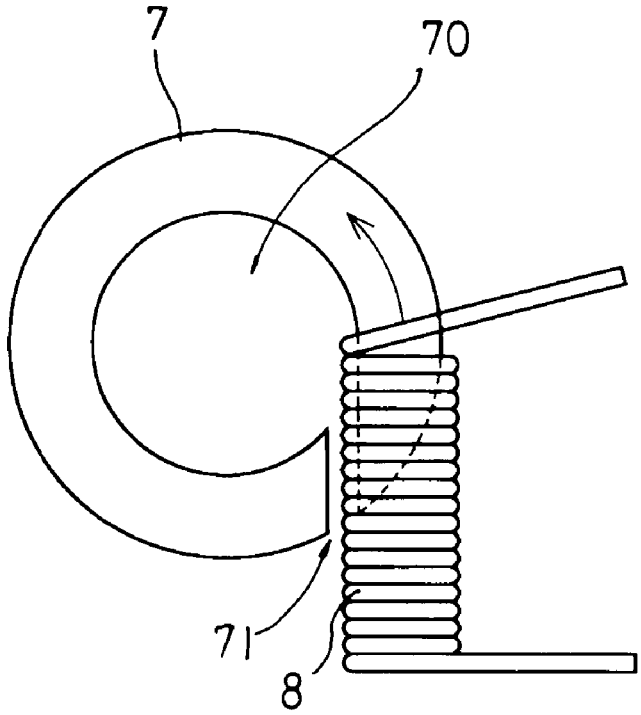
FIG. 13 PRIOR ART
FIG. 13 includes diagrams showing a step included in a conventional process for fabricating a choke coil.
Figure 13:
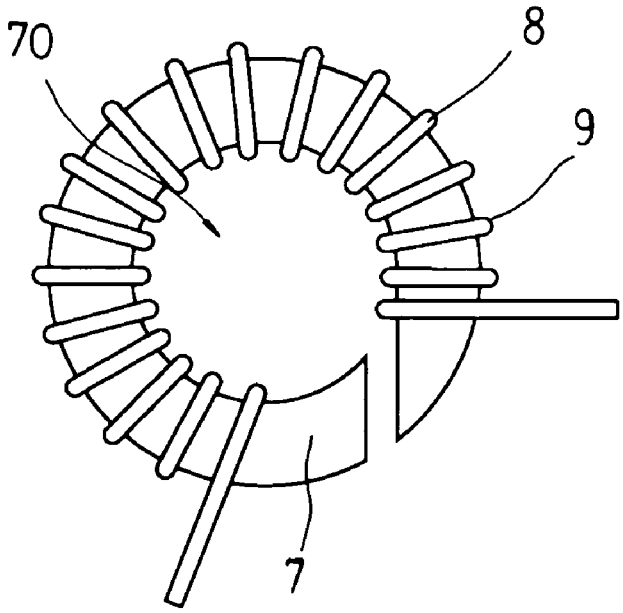
FIG. 13 PRIOR ART

Furthermore, the conductor 39 for use in making the air-core coil 4 is not limited to a single wire like the conductor used in the foregoing embodiment but can be a conductor bundle 39*c* comprising at least two conductors 39*a*, 39*b* as shown in FIG. 12. Like the single conductor, the conductor bundle 39 is wound around the jig 3 to form unit coil portions comprising one or a plurality of conductor bundles 39*c* and having a great inner peripheral length, and unit coil portions comprising one or a plurality of conductor bundles 39*c* and having a small inner peripheral length. As is the case with the above embodiment, the unit coil portions of small inner peripheral length are at least partly forced inwardly of those of large inner peripheral length by the air-core coil fitting step to form two coil layers inside a core center bore.

The invention claimed is:

1. A process for fabricating a coil device comprising a coil fitted around a core, the coil device fabricating process comprising the steps of:

making an air-core coil comprising a plurality of unit coil portions arranged axially of the coil, each of the unit coil portions having one or a plurality of turns of conductor, each pair of unit coil portions adjacent to each other axially of the coil being different from each other in inner peripheral length, and fitting the air-core coil around a C-shaped core while at least partly forcing the unit coil portions of small inner peripheral length inwardly of the unit coil portions of great inner peripheral length by compressing the air-core coil axially thereof.

2. A process for fabricating a coil device according to claim 1 wherein the step of making an air-core coil is performed by winding the conductor around an outer peripheral surface of a wire winding jig, and the winding jig comprises a plurality of winding core portions arranged axially of the jig, each pair of adjacent winding core portions being different from each other in outer peripheral length, the unit coil portion of small inner peripheral length being formed by winding the conductor around the winding core portion of the jig having a small outer peripheral length, the unit coil portion of great inner peripheral length being formed by winding the conductor around the winding core portion of the jig having a great outer peripheral length, wherein the air-core coil is fitted around the core in the step of fitting the air-core coil by passing a side portion of the air-core coil into a center hole of the core through a gap portion formed by cutting away a portion of the core, and wherein the step of fitting the air-core coil forces the unit coil portions of small inner peripheral length inwardly of the unit coil portions of great inner peripheral length on the inner peripheral side of the core.

3. A process for fabricating a coil device according to claim 1 wherein the step of making an air-core coil is performed by winding the conductor around an outer peripheral surface of a wire winding jig, and the winding jig comprises a plurality of winding core portions arranged axially of the jig, each pair of adjacent winding core portions being different from each other in outer peripheral length, the unit coil portion of small inner peripheral length being formed by winding the conductor around the winding core portion of the jig having a small outer peripheral length, the unit coil portion of great inner peripheral length being formed by winding the conductor around the winding core portion of the jig having a great outer peripheral length, wherein the air-core coil is fitted around the core in the step of fitting the air-core coil by passing a side portion of the air-core coil into a center hole of the core through a gap portion formed by cutting away a portion of the core, and wherein the step of making the air-core coil alternately forms the unit coil portions of great inner peripheral length and the unit coil portions of small inner peripheral length, and forms a unit coil portion having the small inner peripheral length and a larger number of turns of conductor than the unit coil portion of great inner peripheral length at one or a plurality of locations when forming the unit coil portions of small inner peripheral length.

4. A process for fabricating a coil device according to claim 1 wherein the air-core coil is fitted around the core in the step of fitting the air-core coil by passing a side portion of the air-core coil into a center hole of the core through a gap portion formed by cutting away a portion of the core to form a C-shape of the core.

5. A process for fabricating a coil device according to claim 4 wherein in a section orthogonal to a center axis of the core, the gap portion extends through the core in a direction inclined with respect to a radial direction of the core, a core end portion having a more remote of gap portion-defining two core end faces from the core center axis being inserted into a center bore of the air-core coil in the step of fitting the air-core coil.

6. A process for fabricating a coil device according to claim 1 comprising a coil fitted around a core, the coil device fabricating process comprising the steps of:

making an air-core coil comprising a plurality of unit coil portions arranged axially of the coil, each of the unit coil portions having one or a plurality of turns of conductor, each pair of unit coil portions adjacent to each other axially of the coil being different from each other in inner peripheral length, and fitting the air-core coil around a C-shaped core while at least partly forcing the unit coil portions of small inner peripheral length inwardly of the unit coil portions of great inner peripheral length by compressing the air-core coil axially thereof, wherein the air-core coil is fitted around the core in the step of fitting the air-core coil by passing a side portion of the air-core coil into a center hole of the core through a gap portion formed by cutting away a portion of the core to form a C-shape of the core, and wherein the step of making an air-core coil forms the unit coil portions so that outer peripheral surfaces of the unit coil portions of great inner peripheral length and outer peripheral surfaces of the unit coil portions of small inner peripheral length are aligned at one side portion of the air-core coil to be disposed on an outer peripheral side of the core, the outer peripheral surfaces of the unit coil portions of great inner peripheral length being positioned as projected toward the core center beyond the outer peripheral surfaces of the unit coil portions of small inner peripheral length at the other side portion of the air-core coil to be disposed on an inner peripheral side of the core.

7. A process for fabricating a coil device according to claim 6 wherein the step of fitting the air-core coil passes said other side portion of the air-core coil through the gap portion of the core, with the outer peripheral surfaces of the unit coil portions aligned at said other side portion.

8. A process for fabricating a coil device according to claim 1 wherein the step of making an air-core coil is performed by winding the conductor around an outer peripheral surface of a wire winding jig, and the winding jig comprises a plurality of winding core portions arranged axially of the jig, each pair of adjacent winding core portions being different from each other in outer peripheral length, the unit coil portion of small inner peripheral length being formed by winding the conductor around the winding core portion of the jig having a small outer peripheral length, the unit coil portion of great inner peripheral length being formed by winding the conductor around the winding core portion of the jig having a great outer peripheral length, wherein the air-core coil is fitted around the core in the step of fitting the air-core coil by passing a side portion of the air-core coil into a center hole of the core through a gap portion formed by cutting away a portion of the core, and wherein the step of making an air-core coil forms the unit coil portions so that outer peripheral surfaces of the unit coil portions of great inner peripheral length and outer peripheral surfaces of the unit coil portions of small inner peripheral length are aligned at one side portion of the air-core coil to be disposed on an outer peripheral side of the core, the outer peripheral surfaces of the unit coil portions of great inner peripheral length being positioned as projected toward the core center beyond the outer peripheral surfaces of the unit coil portions of small inner peripheral length at the other side portion of the air-core coil to be disposed on an inner peripheral side of the core.

9. A process for fabricating a coil device according to claim 8 wherein the step of fitting the air-core coil passes said other side portion of the air-core coil through the gap portion of the core, with the outer peripheral surfaces of the unit coil portions aligned at said other side portion.

10. A process for fabricating a coil device according to claim 1 wherein the step of making an air-core coil is performed by winding the conductor around an outer peripheral surface of a wire winding jig, and the winding jig comprises a plurality of winding core portions arranged axially of the jig, each pair of adjacent winding core portions being different from each other in outer peripheral length, the unit coil portion of small inner peripheral length being formed by winding the conductor around the winding core portion of the jig having a small outer peripheral length, the unit coil portion of great inner peripheral length being formed by winding the conductor around the winding core portion of the jig having a great outer peripheral length.

11. A process for fabricating a coil device according to claim 10 wherein the air-core coil is fitted around the core in the step of fitting the air-core coil by passing a side portion of the air-core coil into a center hole of the core through a gap portion formed by cutting away a portion of the core.

12. A process for fabricating a coil device according to claim 11 wherein in a section orthogonal to a center axis of the core, the gap portion extends through the core in a direction inclined with respect to a radial direction of the core, a core end portion having a more remote of gap portion-defining two core end faces from the core center axis being inserted into a center bore of the air-core coil in the step of fitting the air-core coil.

13. A process for fabricating a coil device according to claim 1 wherein the step of making an air-core coil is performed by winding the conductor around an outer peripheral surface of a wire winding jig, and the winding jig comprises a plurality of winding core portions arranged axially of the jig, each pair of adjacent winding core portions being different from each other in outer peripheral length, the unit coil portion of small inner peripheral length being formed by winding the conductor around the winding core portion of the jig having a small outer peripheral length, the unit coil portion of great inner peripheral length being formed by winding the conductor around the winding core portion of the jig having a great outer peripheral length, wherein the air-core coil is fitted around the core in the step of fitting the air-core coil by passing a side portion of the air-core coil into a center hole of the core through a gap portion formed by cutting away a portion of the core, wherein in a section orthogonal to a center axis of the core, the gap portion extends through the core in a direction inclined with respect to a radial direction of the core, a core end portion having a more remote of gap portion-defining two core end faces from the core center axis being inserted into a center bore of the air-core coil in the step of fitting the air-core coil, and wherein the step of making an air-core coil forms the unit coil portions so that outer peripheral surfaces of the unit coil portions of great inner peripheral length and outer peripheral surfaces of the unit coil portions of small inner peripheral length are aligned at one side portion of the air-core coil to be disposed on an outer peripheral side of the core, the outer peripheral surfaces of the unit coil portions of great inner peripheral length being positioned as projected toward the core center beyond the outer peripheral surfaces of the unit coil portions of small inner peripheral length at the other side portion of the air-core coil to be disposed on an inner peripheral side of the core.

14. A process for fabricating a coil device according to claim 13 wherein the step of fitting the air-core coil passes said other side portion of the air-core coil through the gap portion of the core, with the outer peripheral surfaces of the unit coil portions aligned at said other side portion.

15. A process for fabricating a coil device according to claim 14 wherein the step of fitting the air-core coil forces the unit coil portions of small inner peripheral length inwardly of the unit coil portions of great inner peripheral length on the inner peripheral side of the core.

16. A process for fabricating a coil device according claim 15 wherein the step of making the air-core coil alternately forms the unit coil portions of great inner peripheral length and the unit coil portions of small inner peripheral length, and forms a unit coil portion having the small inner peripheral length and a larger number of turns of conductor than the unit coil portion of great inner peripheral length at one or a plurality of locations when forming the unit coil portions of small inner peripheral length.

17. A process for fabricating a coil device comprising a coil fitted around a core, the coil device fabricating process comprising the steps of:

making an air-core coil comprising a plurality of unit coil portions arranged axially of the coil, each of the unit coil portions having one or a plurality of turns of conductor, each pair of unit coil portions adjacent to each other axially of the coil being different from each other in inner peripheral length, and fitting the air-core coil around a C-shaped core while at least partly forcing the unit coil portions of small inner peripheral length inwardly of the unit coil portions of great inner peripheral length by compressing the air-core coil axially thereof, wherein the air-core coil is fitted around the core in the step of fitting the air-core coil by passing a side portion of the air-core coil into a center hole of the core through a gap portion formed by cutting away a portion of the core to form a C-shape of the core, wherein in a section orthogonal to a center axis of the core, the gap portion extends through the core in a direction inclined with respect to a radial direction of the core, a core end portion having a more remote of gap portion-defining two core end faces from the core center axis being inserted into a center bore of the air-core coil in the step of fitting the air-core coil, and wherein the step of making an air-core coil forms the unit coil portions so that outer peripheral surfaces of the unit coil portions of great inner peripheral length and outer peripheral surfaces of the unit coil portions of small inner peripheral length are aligned at one side portion of the air-core coil to be disposed on an outer peripheral side of the core, the outer peripheral surfaces of the unit coil portions of great inner peripheral length being positioned as projected toward the core center beyond the outer peripheral surfaces of the unit coil portions of small inner peripheral length at the other side portion of the air-core coil to be disposed on an inner peripheral side of the core.

18. A process for fabricating a coil device according to claim 17 wherein the step of fitting the air-core coil passes said other side portion of the air-core coil through the gap portion of the core, with the outer peripheral surfaces of the unit coil portions aligned at said other side portion.

19. A process for fabricating a coil device comprising a coil fitted around a core, the coil device fabricating process comprising the steps of:

making an air-core coil comprising a plurality of unit coil portions arranged axially of the coil, each of the unit coil portions having one or a plurality of turns of conductor, each pair of unit coil portions adjacent to each other axially of the coil being different from each other in inner peripheral length, and fitting the air-core coil around a C-shaped core while at least partly forcing the unit coil portions of small inner peripheral length inwardly of the unit coil portions of great inner peripheral length by compressing the air-core coil axially thereof, wherein the air-core coil is fitted around the core in the step of fitting the air-core coil by passing a side portion of the air-core coil into a center hole of the core through a gap portion formed by cutting away a portion of the core to form a C-shape of the core, and wherein the step of fitting the air-core coil forces the unit coil portions of small inner peripheral length inwardly of the unit coil portions of great inner peripheral length on the inner peripheral side of the core.

20. A process for fabricating a coil device comprising a coil fitted around a core, the coil device fabricating process comprising the steps of:

making an air-core coil comprising a plurality of unit coil portions arranged axially of the coil, each of the unit coil portions having one or a plurality of turns of conductor, each pair of unit coil portions adjacent to each other axially of the coil being different from each other in inner peripheral length, and fitting the air-core coil around a C-shaped core while at least partly forcing the unit coil portions of small inner peripheral length inwardly of the unit coil portions of great inner peripheral length by compressing the air-core coil axially thereof, wherein the air-core coil is fitted around the core in the step of fitting the air-core coil by passing a side portion of the air-core coil into a center hole of the core through a gap portion formed by cutting away a portion of the core to form a C-shape of the core, and wherein the step of making the air-core coil alternately forms the unit coil portions of great inner peripheral length and the unit coil portions of small inner peripheral length, and forms a unit coil portion having the small inner peripheral length and a larger number of turns of conductor than the unit coil portion of great inner peripheral length at one or a plurality of locations when forming the unit coil portions of small inner peripheral length.

* * * * *

UNITED STATES PATENT AND TRADEMARK OFFICE

CERTIFICATE OF CORRECTION

PATENT NO. : 7,120,991 B2
APPLICATION NO. : 10/481891
DATED : October 17, 2006
INVENTOR(S) : Hitoshi Yoshimori It is certified that error appears in the above-identified patent and that said Letters Patent is hereby corrected as shown below:

On the Cover Page and Column 1, line 1:
in item (54) change "METHOD FOR MANUFACTURING COIL DEVICE" to be
-- PROCESS FOR FABRICATING COIL DEVICE --

Signed and Sealed this

Sixteenth Day of October, 2007

JON W. DUDAS
*Director of the United States Patent and Trademark Office*